US006702667B2

(12) United States Patent
Mattice et al.

(10) Patent No.: US 6,702,667 B2
(45) Date of Patent: Mar. 9, 2004

(54) APPARATUS FOR HEATING AND/OR COOLING A BEVERAGE ON A GAMING APPARATUS

(75) Inventors: Sonny Mattice, Gardenerville, NV (US); Chan Griswold, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/938,233

(22) Filed: Aug. 23, 2001

(65) Prior Publication Data

US 2003/0038422 A1 Feb. 27, 2003

(51) Int. Cl.[7] ..... A63F 9/24
(52) U.S. Cl. ..... 463/16; 273/148 R
(58) Field of Search ..... 463/1, 12–13, 463/16–22, 25–28, 30–31, 37, 40–42, 46; 273/148 R, 148 B, 143 R, 269; 220/739, 903; 62/3.2–3.3, 3.64, 371, 457.4, 457.9; 136/200–201, 203

(56) References Cited

U.S. PATENT DOCUMENTS 5,393,057 A * 2/1995 Marnell, II ..... 463/13
5,759,102 A 6/1998 Pease et al. ..... 463/42
5,770,914 A 6/1998 Pease et al. ..... 310/339
5,803,453 A 9/1998 Stephan et al. ..... 273/138.2
5,837,929 A * 11/1998 Adelman ..... 136/225
6,082,114 A * 7/2000 Leonoff ..... 62/3.64
6,116,597 A * 9/2000 Rowe et al. ..... 273/143 R
6,141,969 A * 11/2000 Launchbury et al. ..... 62/3.2
6,159,095 A * 12/2000 Frohm et al. ..... 463/19
6,251,014 B1 6/2001 Stockdale et al. ..... 463/16
6,267,669 B1 7/2001 Luciano, Jr. et al. ..... 463/7
6,280,318 B1 8/2001 Criss-Puszkiewicz et al. ... 454/184
6,290,229 B1 * 9/2001 Perez ..... 273/148 R
2002/0183105 A1 * 12/2002 Cannon et al. ..... 463/16

* cited by examiner

*Primary Examiner*—Kim Nguyen
(74) *Attorney, Agent, or Firm*—Marshall, Gerstein & Borun LLP

(57) ABSTRACT

A gaming apparatus that includes a housing, a display unit that is capable of generating video images, a value input device, and a controller that is coupled to the display unit and the value input device, and includes a processor and a memory that are coupled to the processor. The controller is programmed to allow a person to make a wager, cause a video image to be generated on the display unit, wherein the video image represents a game. The controller is programmed to determine, after the video image has been displayed, a value payout associated with an outcome of the game. The apparatus also includes a beverage support structure coupled to the housing, and including a beverage present detector, a beverage temperature monitor, a beverage temperature altering mechanism, and a timer.

7 Claims, 17 Drawing Sheets

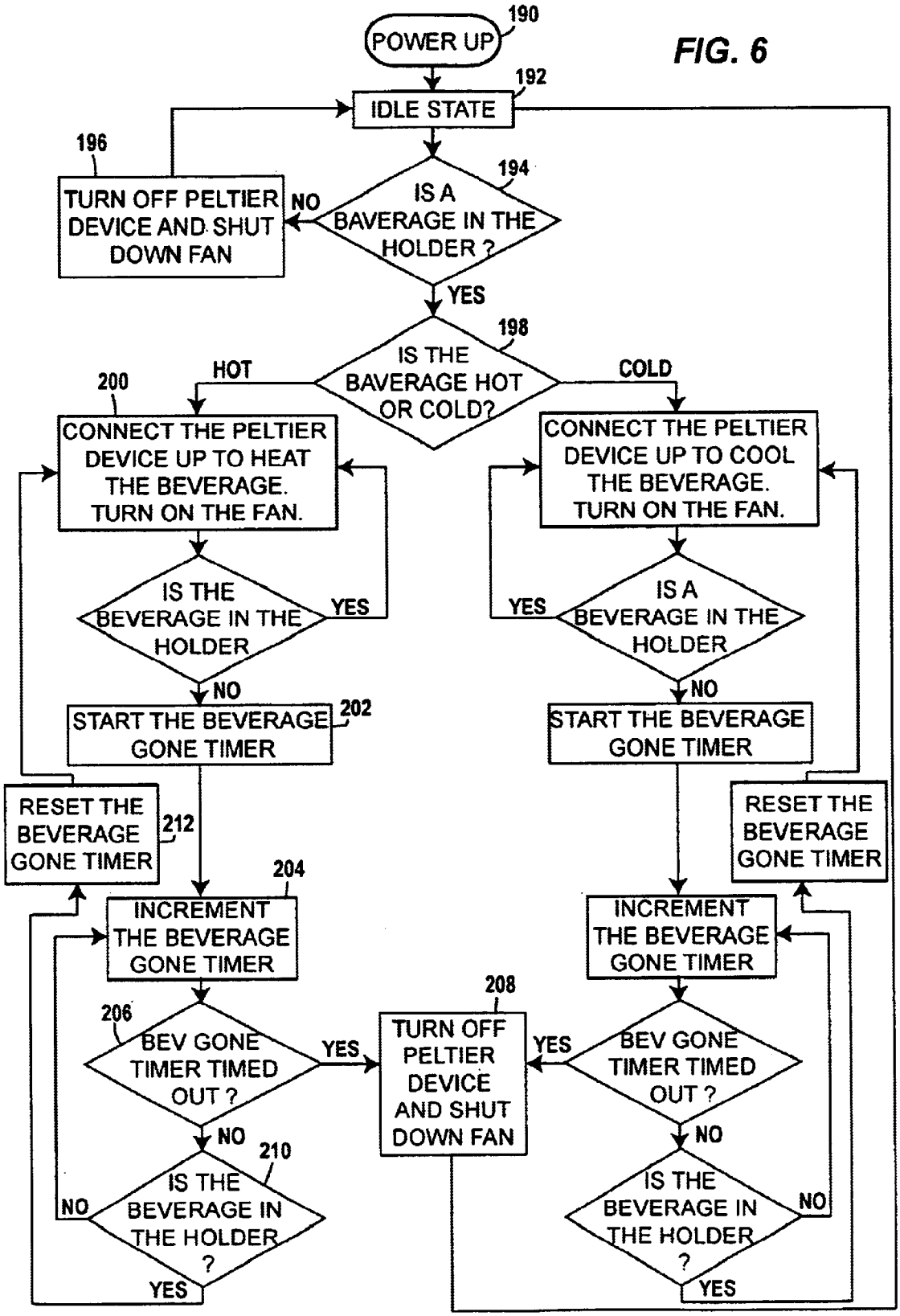
FIG. 6
POWER UP
190
IDLE STATE
192
IS A BAVERAGE IN THE HOLDER ?
194
NO
TURN OFF PELTIER DEVICE AND SHUT DOWN FAN
196
YES
IS THE BAVERAGE HOT OR COLD?
198
HOT
COLD
CONNECT THE PELTIER DEVICE UP TO HEAT THE BEVERAGE. TURN ON THE FAN.
200
CONNECT THE PELTIER DEVICE UP TO COOL THE BEVERAGE. TURN ON THE FAN.
IS THE BEVERAGE IN THE HOLDER
YES
NO
IS A BEVERAGE IN THE HOLDER
YES
NO
START THE BEVERAGE GONE TIMER
202
START THE BEVERAGE GONE TIMER
RESET THE BEVERAGE GONE TIMER
212
RESET THE BEVERAGE GONE TIMER
INCREMENT THE BEVERAGE GONE TIMER
204
INCREMENT THE BEVERAGE GONE TIMER
BEV GONE TIMER TIMED OUT ?
206
YES
NO
TURN OFF PELTIER DEVICE AND SHUT DOWN FAN
208
YES
BEV GONE TIMER TIMED OUT ?
NO
IS THE BEVERAGE IN THE HOLDER ?
210
NO
YES
IS THE BEVERAGE IN THE HOLDER ?
NO
YES

APPARATUS FOR HEATING AND/OR COOLING A BEVERAGE ON A GAMING APPARATUS

BACKGROUND OF THE INVENTION

The present invention is directed to a gaming apparatus, which could be either an individual gaming apparatus or a gaming system having a plurality of gaming apparatuses, wherein the gaming apparatuses are capable of warming or cooling a liquid beverage.

It is a customary practice in casinos or other facilities to provide hot or cold beverages to players who are using gaming apparatuses. In conventional gaming apparatuses, nothing is provided to keep the players' beverages hot or cold. Therefore, the liquid in the beverages change temperatures. A hot beverage will cool down toward room temperature and a cold beverage will warm up toward room temperature. After a length of time, the beverage no longer has the taste appeal that a hot or cold beverage has. To make matters worse, most conventional beverage holders are made of metals that dissipate the heat or cold from the beverage very quickly, thus speeding up the process of warming cold drinks and cooling hot drinks.

Many establishments have attempted to resolve this problem by hiring additional employees to walk around the facility and replace the players' beverages. Because many of the establishments provide free beverages to the players, replacing the beverages before they are finished creates a waste in both beverage supply costs and in labor costs. In most cases, the players are eager to replace their drink with a new one because the beverages are served cost free to the players. Additionally, there are some establishments that exist wherein the players or customers are required to pay for their beverages.

SUMMARY OF THE INVENTION

The invention is directed to a gaming apparatus that may comprise a housing and a display unit that is associated with the housing. The display unit is also capable of generating video images. The gaming apparatus also includes a value input device that is capable of allowing the player to deposit a medium of value, and a controller, wherein the controller is operatively coupled to the display unit and the value input device. The controller may have a processor and a memory operatively coupled to the processor. Additionally, the controller may be programmed to allow a person to make a wager and to cause a video image to be generated on the display unit after the value input device detects deposit of value by the person.

The video image may represent a casino game selected from the group of casino games consisting of video poker, video blackjack, video slots, video keno and video bingo, in which case the video image may comprise an image of at least five playing cards if the game comprises video poker. Likewise, the video image may comprise an image of a plurality of playing cards if the game comprises video blackjack. If the game selected by the player is video slots, the video image may comprise an image of a plurality of simulated slot machine reels. The video image may comprise an image of a plurality of keno numbers if the game comprises video keno, or the video image may comprise an image of a bingo grid if the game comprises video bingo. The controller may also be programmed to determine an outcome of the game represented by the video image and a value payout associated with the outcome of the game.

The gaming apparatus may also include a beverage temperature control system that may comprise a beverage support structure coupled to the housing, a beverage present detector, a beverage temperature monitor, and a beverage temperature altering mechanism that is operatively coupled to the beverage support structure. The temperature altering mechanism may include a thermoelectric device that has a first semiconductor material and a second semiconductor material connected electrically in series and thermally in parallel.

The features and advantages of the present invention will be apparent to those of ordinary skill in the art in view of the detailed description of various embodiments, which is made with reference to the drawings, a brief description of which is provided below.

BRIEF DESCRIPTION OF THE DRAWINGS

FIG. 6 is a flowchart of an embodiment of a beverage heating and cooling system;

DETAILED DESCRIPTION OF VARIOUS EMBODIMENTS

Figure 1:
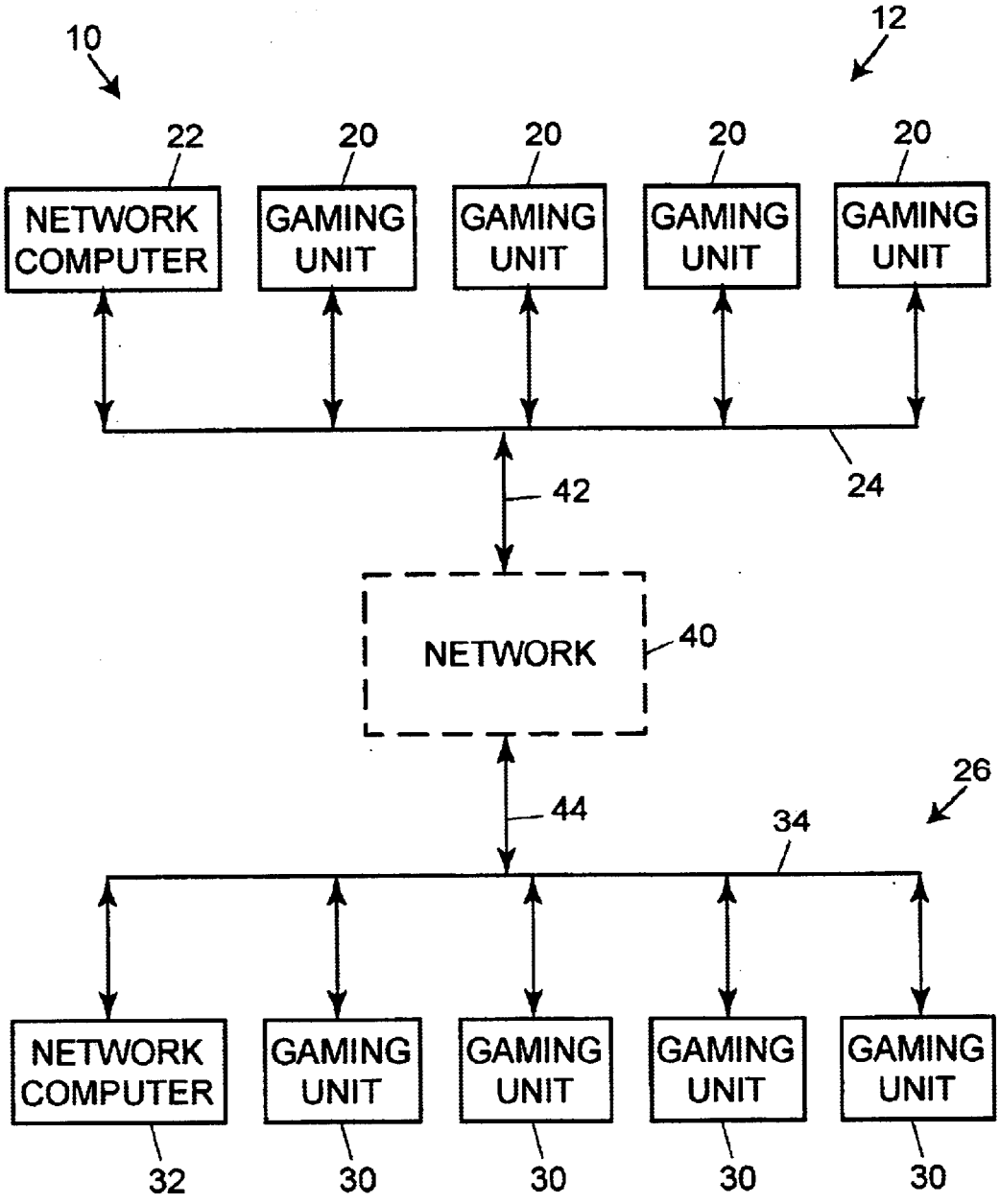
FIG. 1 is a block diagram of an embodiment of a gaming system in accordance with the invention.

FIG. 1 illustrates an embodiment of a gaming system 10 in accordance with the invention. It should be noted that the terms "gaming system" and "gaming apparatus" are intended to embrace lotteries. Likewise, when referring to "a casino game" or "game," it is intended that these term also includes a lottery. Referring to FIG. 1, the gaming system 10 may include a first group or network 12 of gaming units 20 operatively coupled to a network computer 22 via a network data link or bus 24. The gaming system 10 may include a second group or network 26 of gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. It should also be noted that the gaming units 20 and 30 may also be provided in facilities not conventionally referred to as casinos, such as retail stores, bars, restaurants, terminals, etc. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
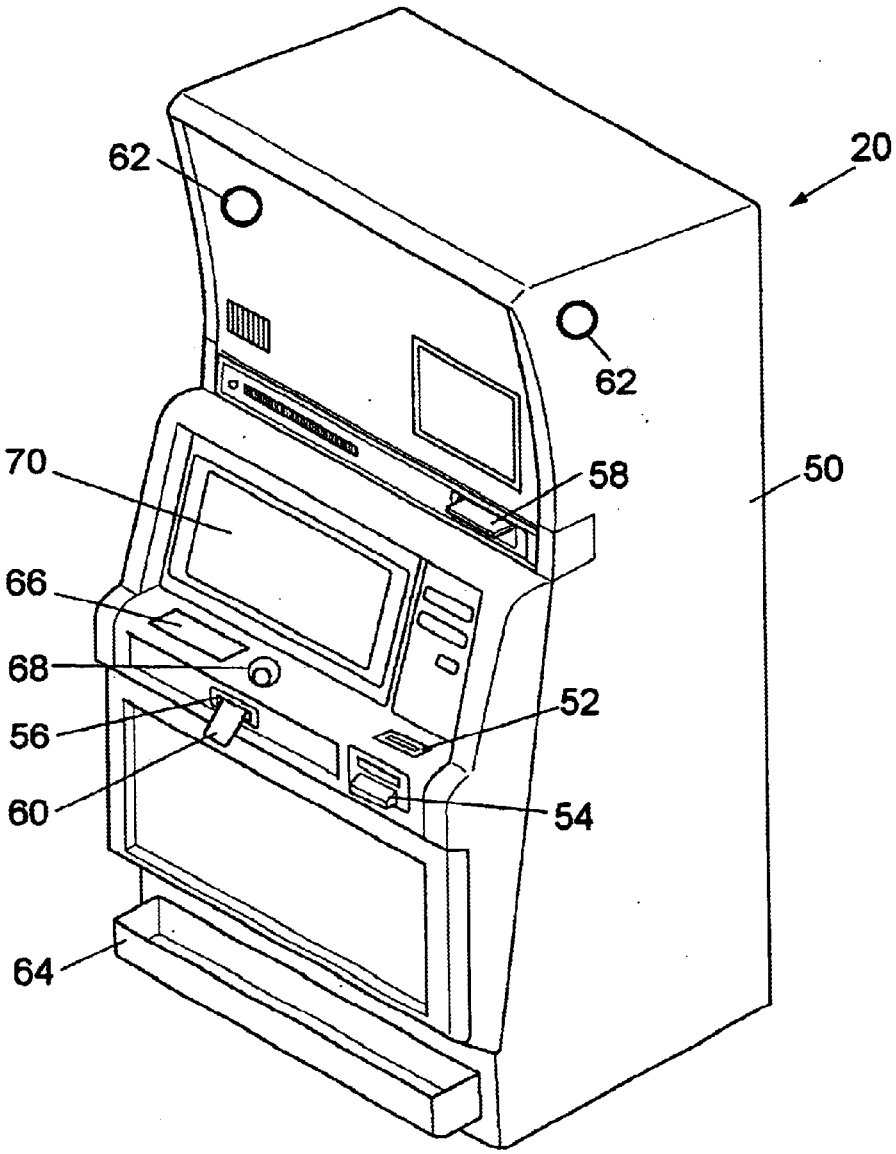
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of gaming unit and may have various different structures and methods of operation. For exemplary purposes, various designs of the gaming units 20 are described below, but it should be understood that numerous other designs may be utilized.

Referring to FIG. 2, the gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, a beverage temperature control system 68, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The beverage support structure 68 may be located anywhere on the housing 50. For example, the beverage support structure 68 may be located on the front of the gaming apparatus 20 as shown in FIG. 2, or it may be mounted on a side of the housing 50. The beverage support structure 68 may also be located on the top of the gaming apparatus 20 if the gaming apparatus 20 is designed to fit into a bar top or table top. The beverage support structure's actual location on the gaming apparatus 20 is not important, as its main purpose is to hold beverages upright so that the liquid disposed within the beverage container does not spill out. The input control panel 66 may be provided with a plurality of pushbuttons or touch-sensitive areas that may be pressed by a player to select games, make wagers, make gaming decisions, etc.

Figure 2A:
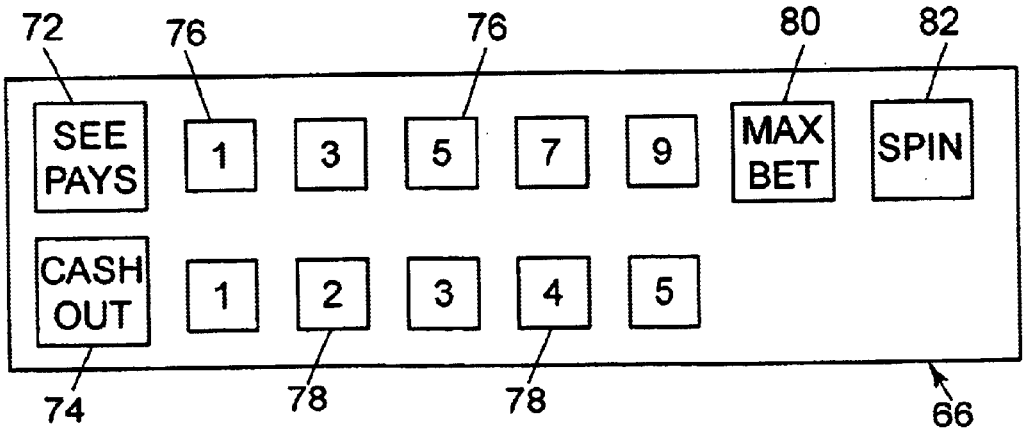
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to-terminate play on the gaming unit 20, in which case the gaming unit 20 may return value to the player, such as: by returning a number of coins to the player via the payout tray 64, printing a ticket 60, or writing information to a card 58.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that the rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Figure 3:
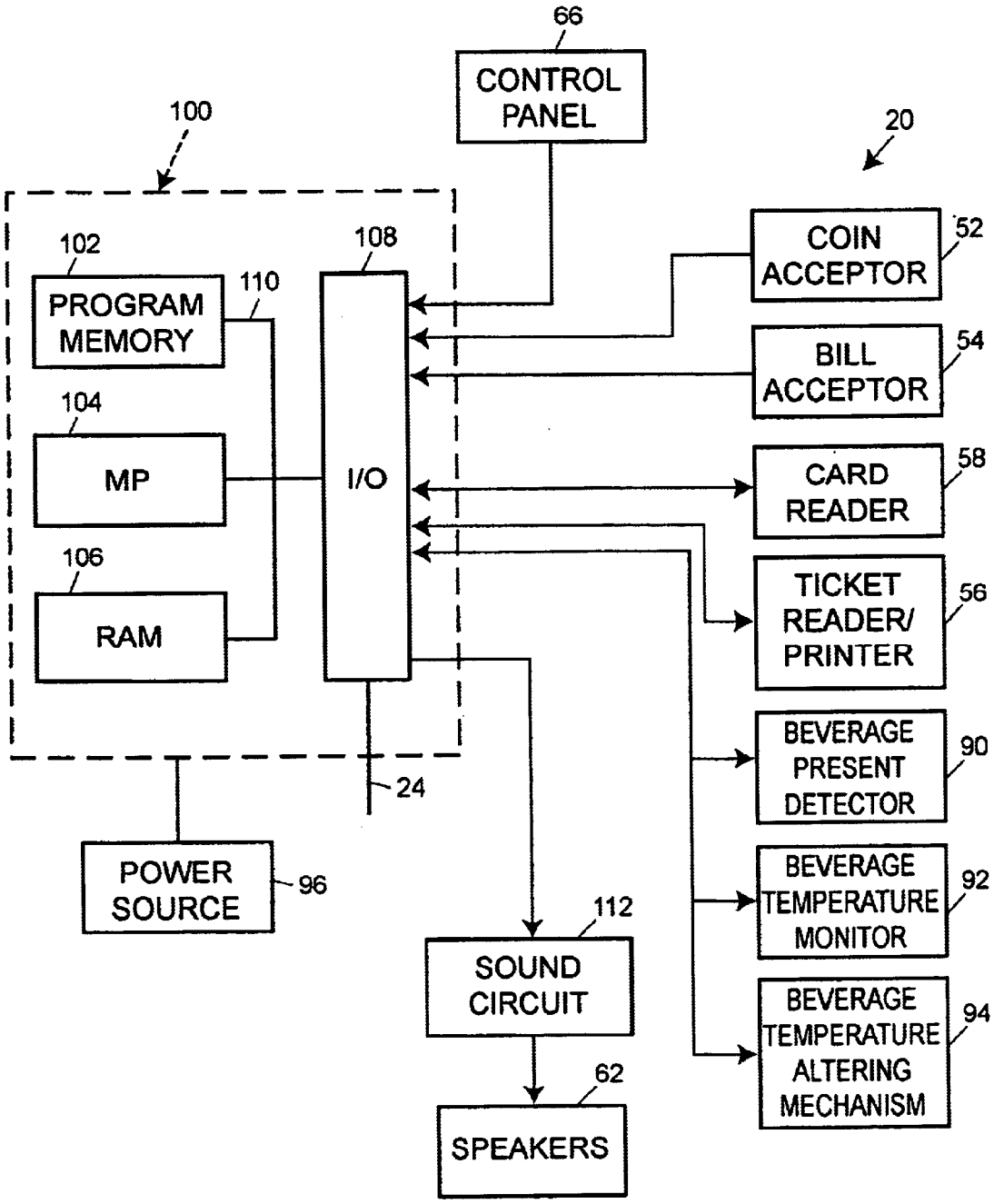
FIG. 3 is a block diagram of the electronic components of the gaming unit of FIG. 2.

The temperature control system 68 may include a beverage present detector 90, a beverage temperature monitor 92, and a beverage temperature altering mechanism 94 (see FIG. 3).

Gaming Unit Electronics

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 106 and program memories 102 may be implemented as semiconductor memories, magnetically readable memories, and/or optically readable memories, for example.

FIG. 3 illustrates that the control panel 66, the coin acceptor 52, the bill acceptor 54, the ticket reader/printer 56, the card reader 58, a beverage present detector 90, a beverage temperature monitor 92, and a beverage temperature altering mechanism 94, may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108. A power source 96 may be utilized to provide electrical power for the controller 100 and the interconnected components 52, 54, 56, 58, 66, 90, 92, 94, and 112.

As shown in FIG. 3, the components 52, 54, 56, 58, 66, 90, 92, 94, and 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Figure 4:
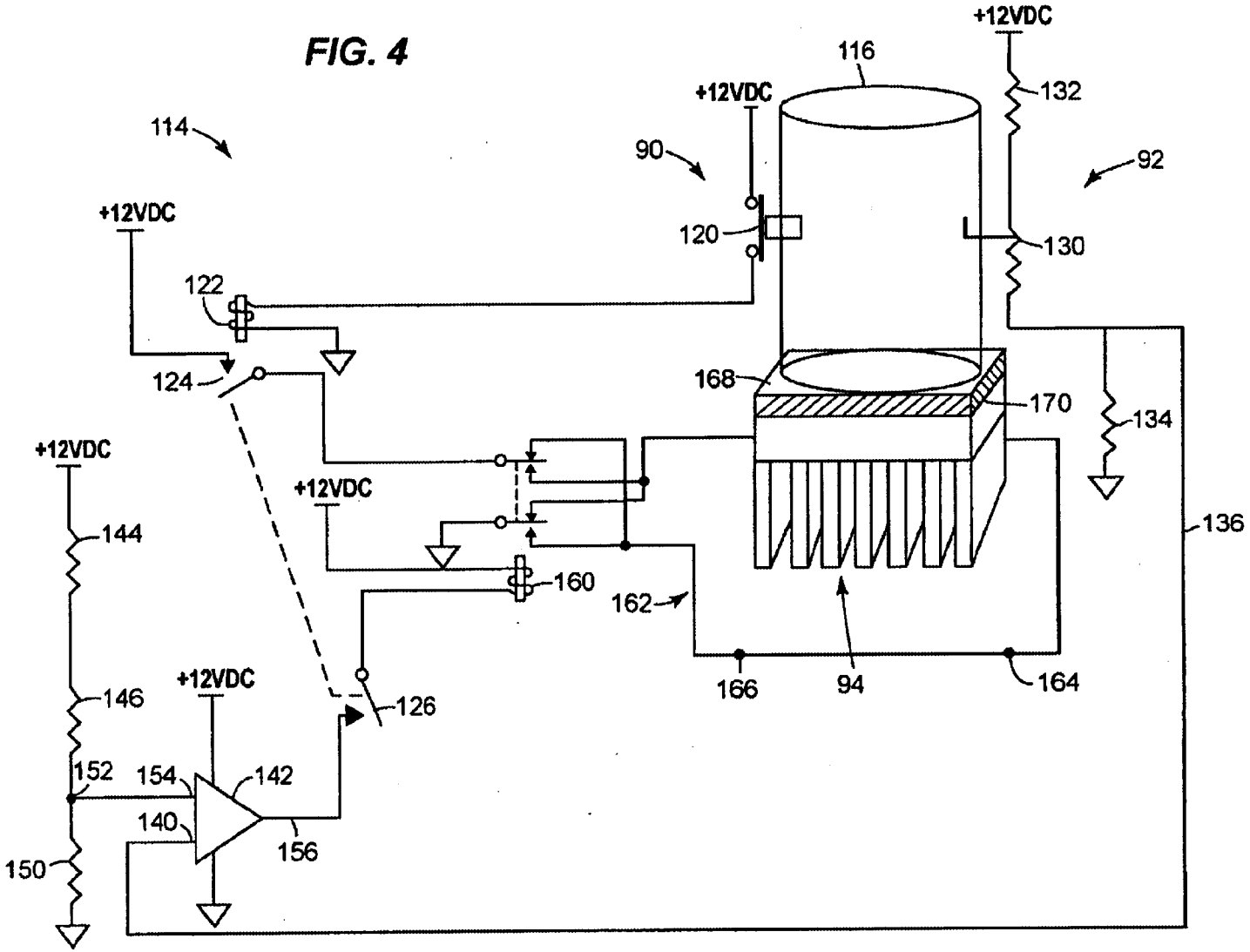
FIG. 4 illustrates schematically an embodiment of a beverage heating and cooling system.

FIG. 4 illustrates schematically an embodiment of a beverage temperature control system 68. The temperature control system 68 may include an aluminum beverage support structure 116, a beverage temperature altering mechanism 94, and an assembly of electronic components that are combined to create a beverage present detector 90 and a beverage temperature monitor 92.

The beverage present detector 90 of FIG. 4 may include a beverage present switch 120 that is located on the side of the beverage support structure 116. When a beverage container is placed in the beverage support structure 116, the beverage container may displace the beverage present switch 120 indicating to the electronic circuitry that a beverage container is inside the beverage support structure 116. Displacing the beverage present switch 120 may cause the switch 120 to close, which energizes the beverage present relay 122. Energizing the beverage present relay 122 may cause a first contact 124 and a second contact 126 to close. Thus, the presence of a beverage is detected and the beverage temperature monitor 92 and beverage temperature altering mechanism 94 may be activated.

The beverage temperature monitor 92 of FIG. 4 may include a temperature sensitive resistor 130 that contacts a side of the beverage container when it is placed within or on the beverage support structure 116. The temperature sensitive resistor 130 may have a positive temperature coefficient. In other words, its resistance may increase with an increase of temperature. One possible temperature sensitive resistor may have 100 ohms of resistance at 25 degrees Celsius. The beverage temperature monitor may also include a second resistor 132 and a third resistor 134. The resistors 132 and 134 may be 10,000 ohm resistors, for example. The resistors 130–134 are electrically interconnected as shown in FIG. 4 to form a voltage divider to provide an output voltage on a line 136 that corresponds to the beverage container temperature. The output line 136 of the voltage divider may be connected to a negative input 140 of a voltage comparator 142.

A fourth resistor 144, a fifth resistor 146, and a sixth resistor 150 may be interconnected to form a second voltage divider, wherein the voltage on an output line 152 of the second voltage divider may not change as a function of temperature. In other words, the resistors may be selected to produce an output voltage representative of a predetermined room temperature. The resistors 144–150 may be 10,000 ohm resistors. While the voltage on the output line 152 of the second voltage divider illustrated in this embodiment may not change as a function of temperature, it could easily be modified to operate similar to the first voltage divider so that its output voltage is dependent on the ambient temperature of the facility.

The voltage on the output line 152 of the second voltage divider may be connected to the positive input 154 of the voltage comparator 142. The voltage comparator 142 may operate to compare the negative input 140 to the positive input 154. If the voltage from the temperature sensitive resistor 130 is more positive (i.e. hotter) than the voltage on the second voltage divider output line 152 (room temperature reference voltage), then the voltage on an output line 156 of the voltage comparator 142 may be negative or at ground. When the voltage on the output line 156 of the voltage comparator 142 is at ground, and the switch 126 is closed, a heat/cool relay 160 may be energized. Energizing the heat/cool relay 160 may cause the current to flow in the heat/cool circuit 162 in a clockwise direction (from a point 164 to a point 166).

It should be noted that alternative embodiments may be easily created by completely eliminating the beverage present detector 90 or the beverage temperature monitor 92, or both. If for example, both elements 90 and 92 are eliminated, then a cheap, simple system would result wherein the beverage temperature altering mechanism 94 would be continuously powered and operating at a fixed temperature to constantly cool (or heat) the beverage. Additionally, the functions performed by the electronic components comprising the beverage present detector 90 and the beverage temperature monitor 92 may also be performed by use of a controller, such as the controller 100 from FIG. 3.

The beverage temperature altering mechanism 94 utilized in this embodiment is a thermoelectric device. If utilized only for cooling, it may be also referred to as an electrically powered cooling mechanism or an electrically actuable beverage cooling mechanism.

Figure 5:
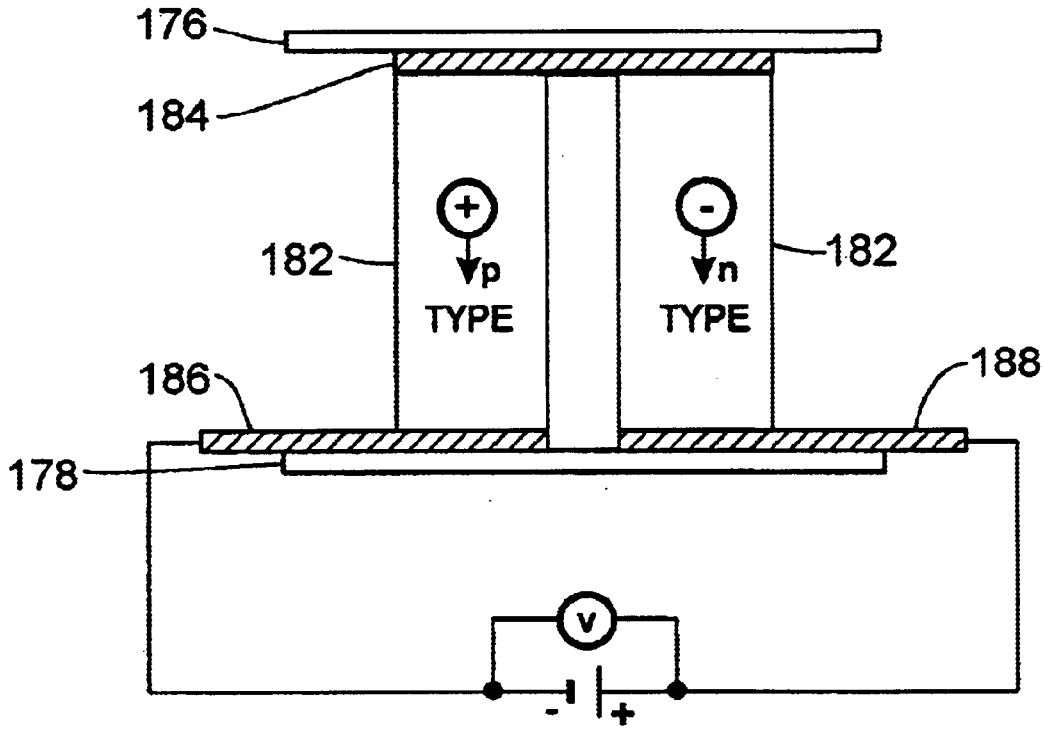
FIG. 5 is a schematic representation of a Peltier thermoelectric device.

A basic illustration of a thermoelectric device is illustrated in FIG. 5. A thermoelectric device is essentially a solid state heat pump that operates on the Peltier effect, which is the theory that there is a heating or cooling effect when electric current passes through two conductors. A voltage applied to the free ends of two dissimilar materials creates a temperature difference. With Peltier cooling for example, this temperature difference, will cause heat to move from one end to the other. The devices operate on direct current, thus the same thermoelectric device may be used for heating by reversing the direction of current flow in the circuit. Thermoelectric devices are solid state and have no moving parts. Thermoelectric heating and cooling may be used in various applications where space limitations and reliability are important and CFCs are not desired.

The thermoelectric device illustrated in FIG. 5 may be a single stage device and may include a first ceramic plate 176 and a second ceramic plate 178. The ceramic plates 176 and 178 may be separated by a first semiconductor material 180 and a second semiconductor material 182. The first semiconductor material 180 may primarily comprise a p type semiconductor and the second semiconductor material 182 may primarily comprise an n type semiconductor. The thermoelectric device may also include a first conductor 184, a second conductor 186, and a third conductor 188 formed between the ceramic plates 176 and 178 and the semiconductor materials 180 and 182 to transfer electrical energy.

The elements of the semiconductor material 180 and 182 may be connected electrically in series and thermally in parallel. When a positive DC voltage is applied to the n type thermoelement 182, electrons may pass from the p type thermoelement 180 to the n type thermoelement 182. Thus, there may be a decrease in temperature at the junction ("cold side") resulting in absorption of heat from the environment. The heat may be carried through the thermoelectric device by electron transport and released on the opposite ("hot") side as the electrons move from a high to low energy state. The heat may then dissipate into a heat sink and its surrounding environment. The heat pumping capacity of a thermoelectric device may be proportional to the current and the number of pairs of n type and p type elements.

Referring back to FIG. 4, the beverage temperature altering mechanism 94 may include a thermoelectric device similar to that shown in FIG. 5. This thermoelectric device may further include a contact plate 168 and a heat sink 170. While not shown, an electric fan may be affixed to or mounted near the heat sink 170 to further dissipate the heat (or cold). Thermal insulating material may also be added to the contact plate 168 to assist in preventing or minimizing cold or heat from escaping when the device is cooling or heating a beverage. When the current flows in the heat/cool circuit 162 in a clockwise direction (from the point 164 to the point 166), the contact plate 168 may increase in temperature. Thus, beverages placed in the beverage support structure 116 may either remain hot or become warmer.

If the voltage on the output line 136 from the first voltage divider is more negative (i.e. colder) than the output voltage on the line 152 at the second voltage divider (room temperature reference voltage) and the switch 126 is closed, then the heat/cool relay 160 may not be energized. This may cause the current to flow through the heat/cool circuit 162 in a counterclockwise direction (from the point 166 to the point 164). This may cause the contact plate 168 to become cool. Thus, a beverage placed in the beverage support structure 116 may remain cold or become cooler.

The beverage temperature control system 68 may also include an interconnected timer to compensate for the removal of a beverage from the beverage support structure 116 for a short predetermined amount of time. The addition of a timer would allow the heat/cool circuit 162 to remain energized for the average time it takes a user to take a drink of the beverage. This would lead to an increase in efficiency and performance.

As mentioned above, many of the functions performed by the electronic components illustrated in FIG. 4 may be similarly performed by replacement with a controller, such as controller 100. It should also be noted that the beverage temperature altering mechanism illustrated in FIG. 4 as an electrically powered thermoelectric device could be replaced with a simple refrigeration system which would include a compressor and piping for a refrigerant such as Freon, as a few basic components.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

FIG. 6 illustrates a logic flow diagram of an exemplary beverage heating and cooling system. The system includes a first block 190 wherein the system is provided electrical power from a power source. The system then remains in an idle state 192 until a block 194 is reached where a beverage is placed in the beverage support structure 116 (i.e. beverage holder). If the system detects that a beverage is not in the beverage holder, a block 196 is reached which includes turning off the thermoelectric Peltier device and shutting off the fan motor that is attached to the heat sink.

If at the block 194, the system detects the presence of a beverage in the beverage holder 116, then the system may detect if the beverage is hot or cold at block 198. If the beverage temperature monitor 92 senses that the beverage temperature is hot, then an appropriate voltage is applied to the thermoelectric device 94 to heat up the beverage and the fan is turned on at a block 200. The system then continues to apply a voltage to the thermoelectric device to heat the beverage until the beverage present detector detects that the beverage has been removed from the beverage support structure. At this point, a block 202 is reached wherein a beverage gone timer is activated.

A next block 204 increments the beverage gone timer by one increment. At a next block 206, the system checks the beverage gone timer to determine if the beverage gone timer has timed out. If the beverage gone timer has timed out, then a next block 208 turns off the thermoelectric device, shuts down the fan, and returns to the idle state 192.

If the beverage gone timer has not timed out, the system again may check if the beverage is in the holder at a block 210. If the beverage has not been returned to the beverage holder, then the system returns to block 204 where the beverage gone timer is incremented again. If at the block 210, the system determines that the beverage has been returned to the beverage holder, then system resets the beverage gone timer at a block 212 and returns to the block 200 where it continues to apply voltage to the thermoelectric device. As seen from FIG. 6, the system performs the same steps if a cold beverage is detected at the block 198. It should also be noted that the operations performed in relation to FIG. 6 may be performed at the same time as the other operations that are described below (FIG. 7).

Figure 7:
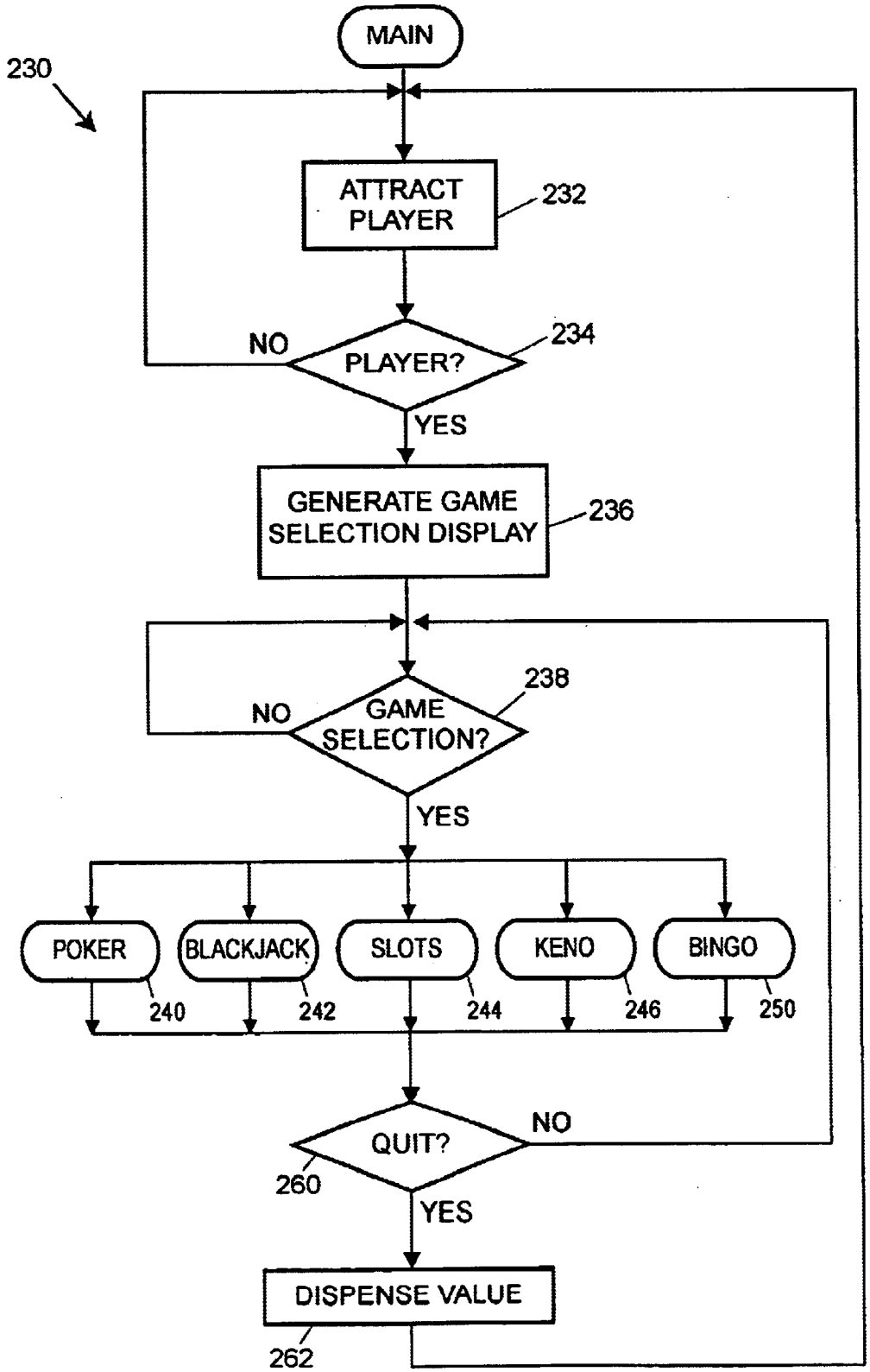
FIG. 7 is a flowchart of an embodiment of a main routine that may be performed during operation of one or more of the gaming units.

FIG. 7 is a flowchart of a main operating routine 230 that may be stored in the memory of the controller 100. Referring to FIG. 7, the main routine 230 may begin operation at block 232 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 234, the attraction sequence may be terminated and a game-selection display may be generated on the display unit 70 at block 236 to allow the player to select a game available on the gaming unit 20. The gaming unit 20 may detect an input at block 234 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 236 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 238, the controller 100 may cause one of a number of game routines to be performed to allow the selected game to be played. For example, the game routines could include a video poker routine 240, a video blackjack routine 242, a slots routine 244, a video keno routine 246, and a video bingo routine 250. At block 238, if no game selection is made within a given period of time, the operation may branch back to block 232.

After one of the routines 240, 242, 244, 246, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 232. If the player did not wish to quit as determined at block 260, the routine may return to block 238 where the game-selection display may again be generated to allow the player to select another game.

It should be noted that although five gaming routines are shown in FIG. 7, a different number of routines could be included to allow play of a different number of games. The gaming unit 20 may also be programmed to allow play of different games.

Figure 8:
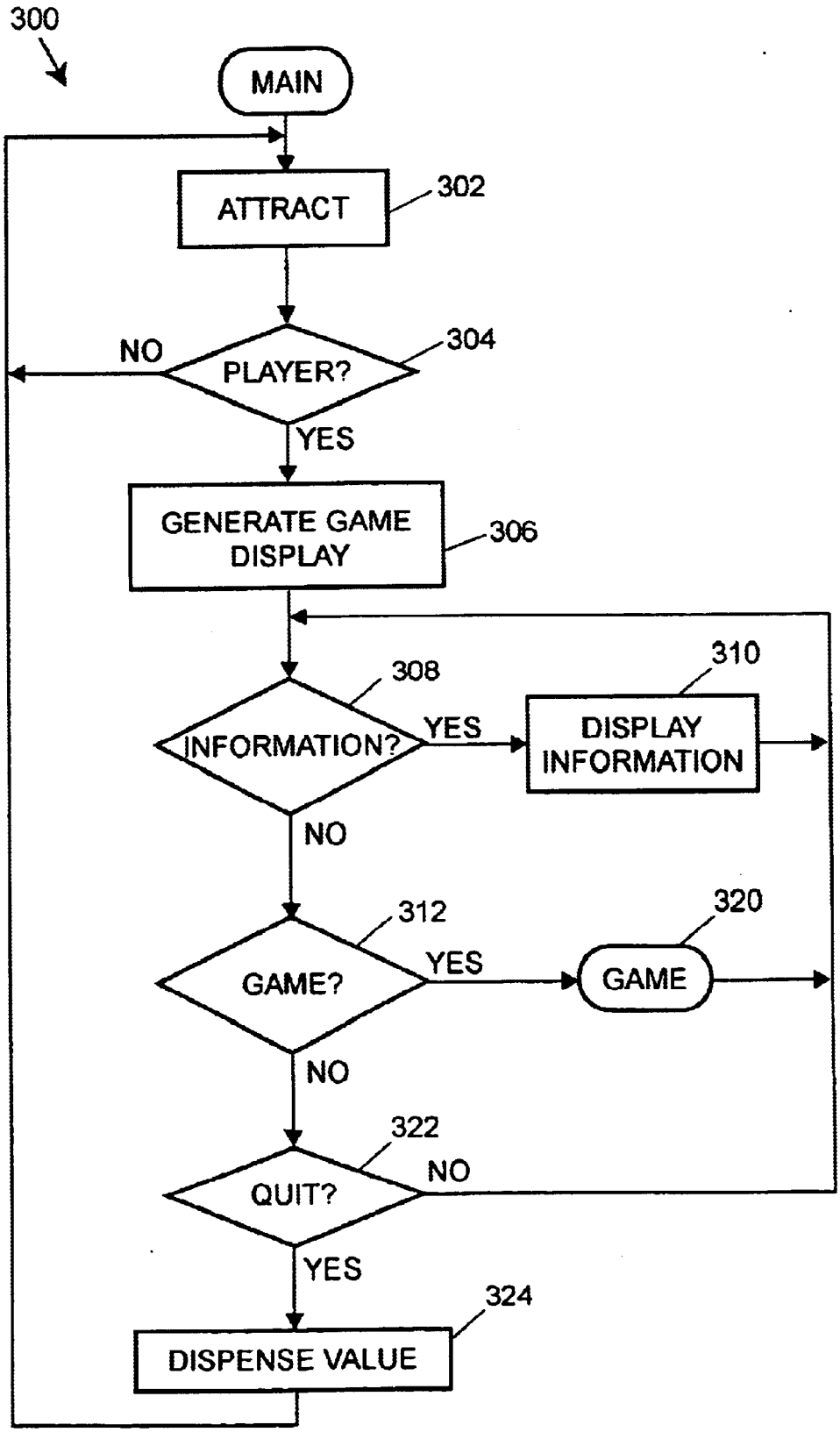
FIG. 8 is a flowchart of an alternative embodiment of a main routine that may be performed during operation of one or more of the gaming units.

FIG. 8 is a flowchart of an alternative main operating routine 300 that may be stored in the memory of the controller 100. The main routine 300 may be utilized for gaming units 20 that are designed to allow play of only a single game or single type of game. Referring to FIG. 8, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 240, 242, 244, 246, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the program may branch back to block 308.

Video Poker

Figure 9:
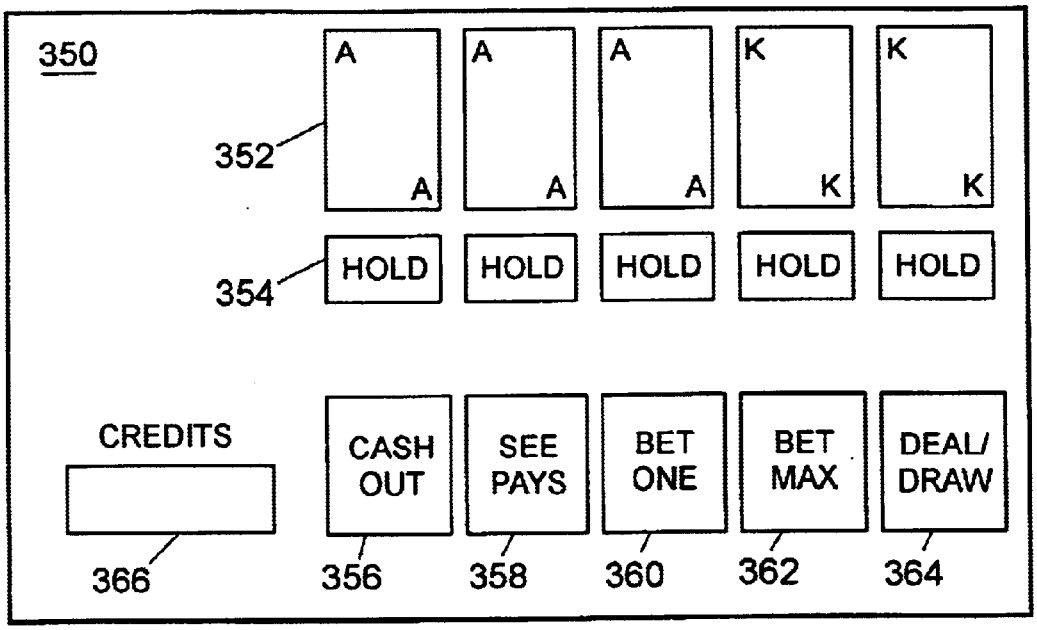
FIG. 9 is an illustration of an embodiment of a visual display that may be displayed during performance of the video poker routine of FIG. 11.

FIG. 9 is an exemplary display 350 that may be shown on the display unit 70 during performance of the video poker routine 240 shown schematically in FIG. 7. Referring to FIG. 9, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 11:
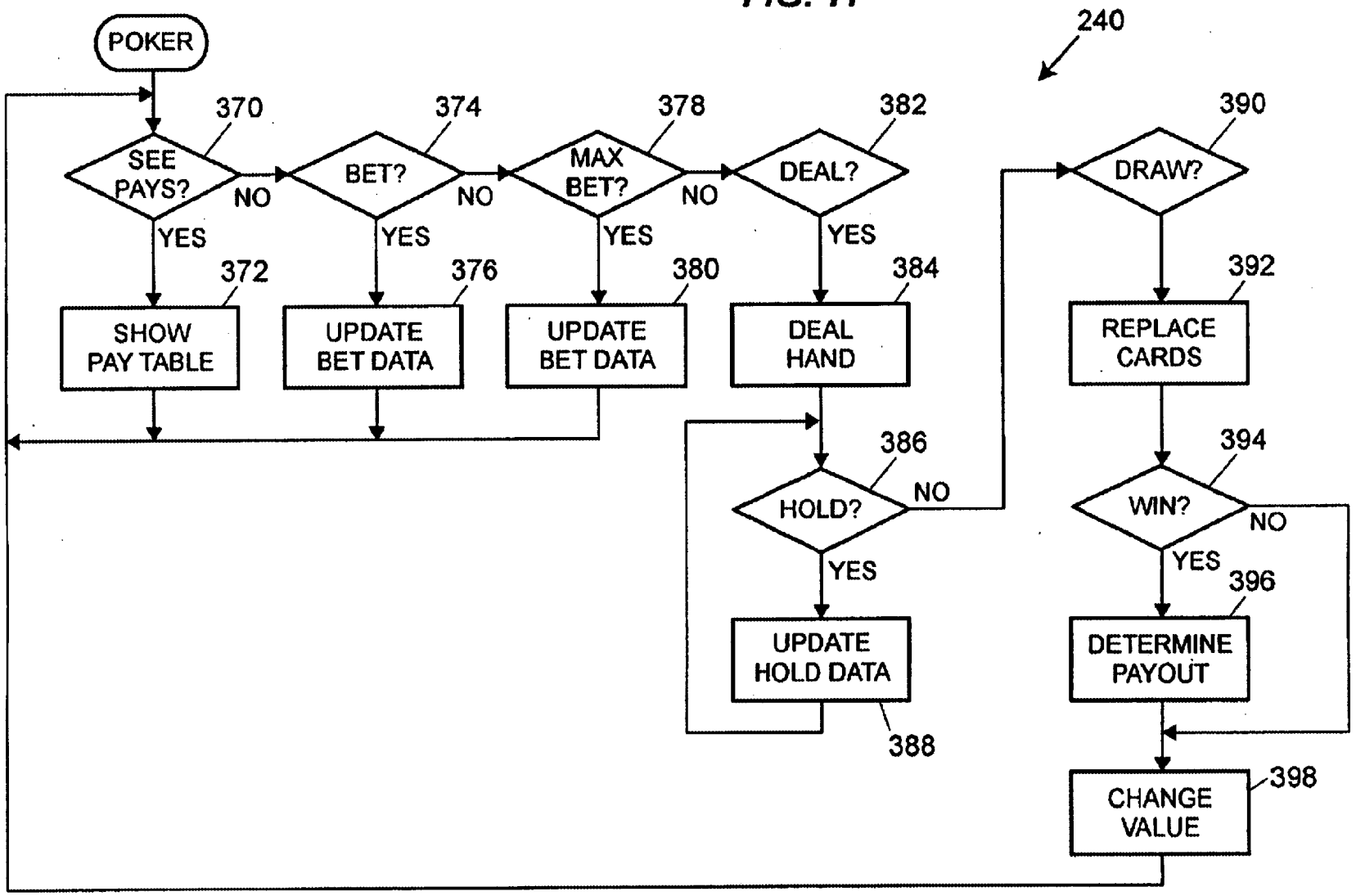
FIG. 11 is a flowchart of an embodiment of a video poker routine that may be performed by one or more of the gaming units.

FIG. 11 is a flowchart of the video poker routine 240 shown schematically in FIG. 7. Referring to FIG. 11, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 9).

Although the video poker routine 240 is described above in connection with a single poker hand of five cards, the routine 240 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 10:
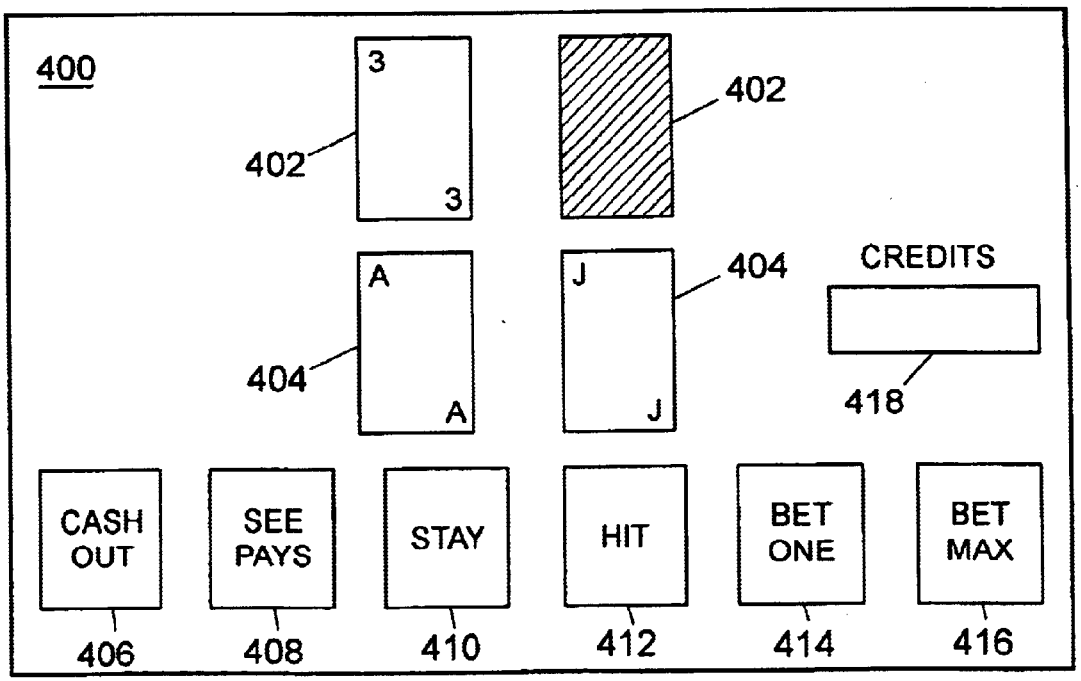
FIG. 10 is an illustration of an embodiment of a visual display that may be displayed during performance of the video blackjack routine of FIG. 12.

FIG. 10 is an exemplary display 400 that may be shown on the display unit 70 during performance of the video blackjack routine 242 shown schematically in FIG. 7. Referring to FIG. 10, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 12:
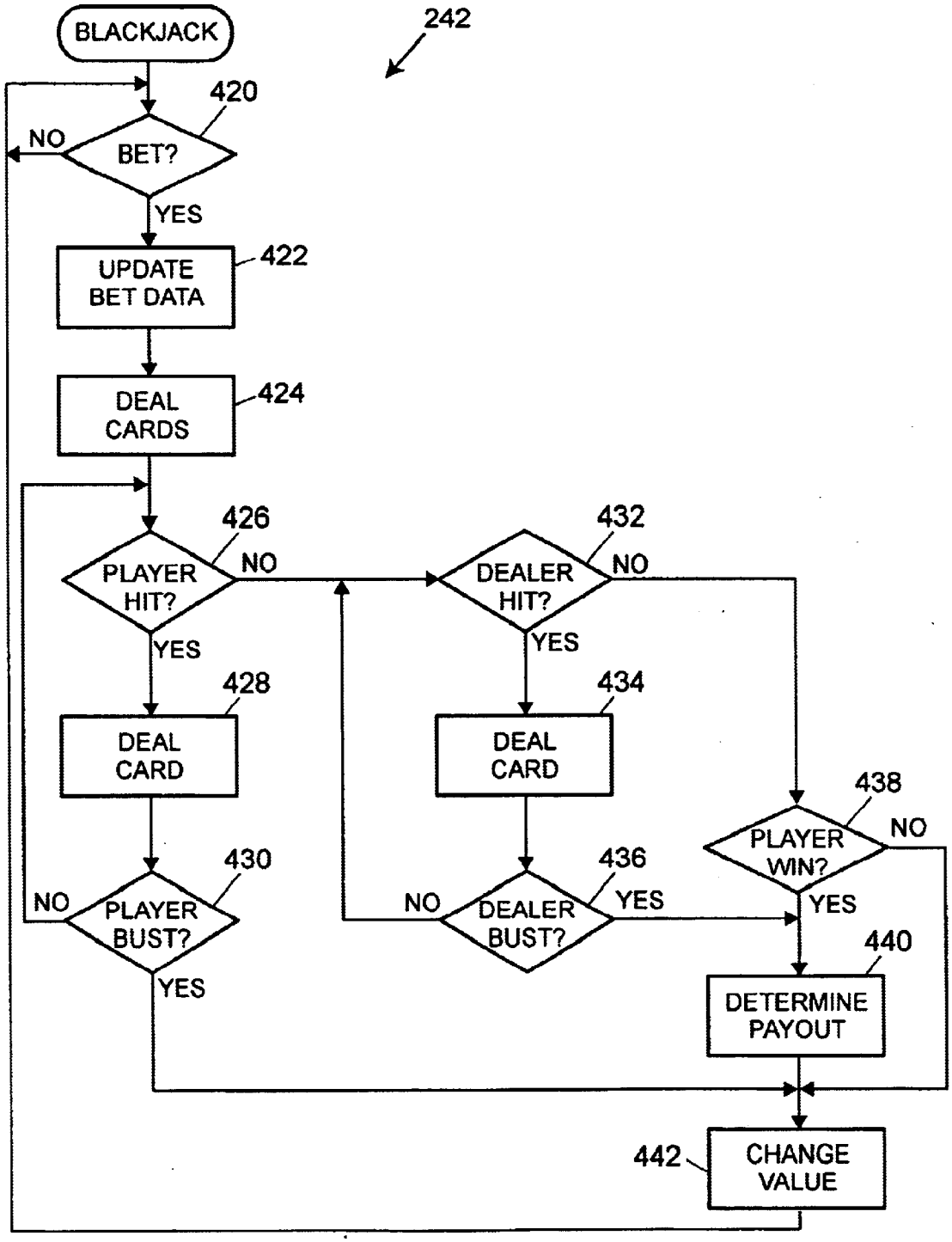
FIG. 12 is a flowchart of an embodiment of a video blackjack routine that may be performed by one or more of the gaming units.

FIG. 12 is a flowchart of the video blackjack routine 242 shown schematically in FIG. 7. Referring to FIG. 12, the video blackjack routine 242 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 396. The cumulative value or number of credits may also be displayed in the display area 418 (FIG. 10).

Slots

Figure 13:
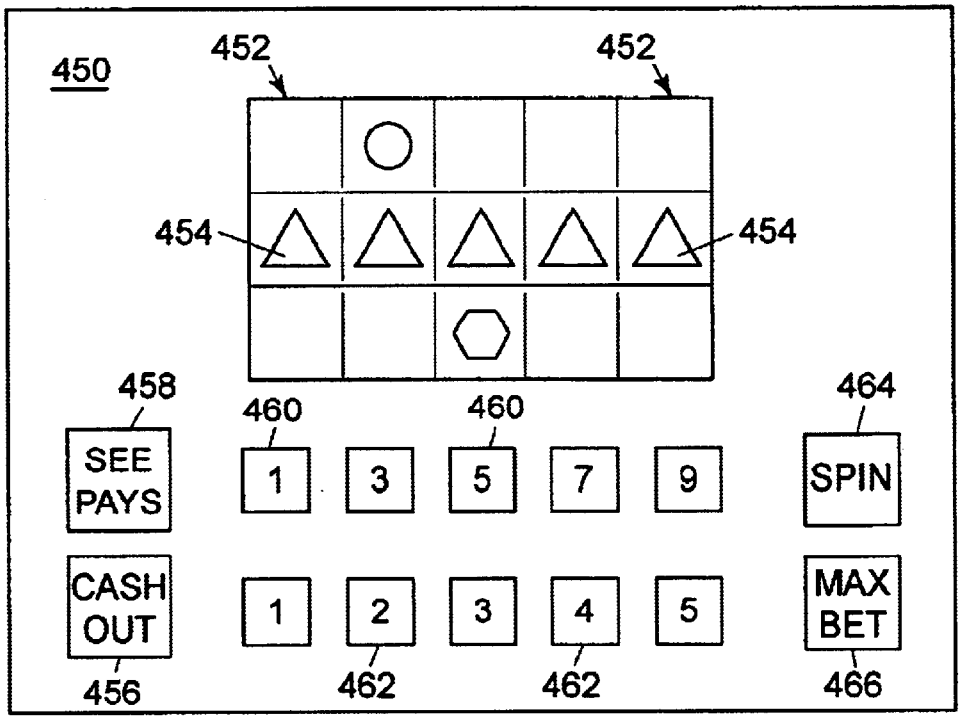
FIG. 13 is an illustration of an embodiment of a visual display that may be displayed during performance of the slots routine of FIG. 15.

FIG. 13 is an exemplary display 450 that may be shown on the display unit 70 during performance of the slots routine 244 shown schematically in FIG. 7. Referring to FIG. 13, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 15:
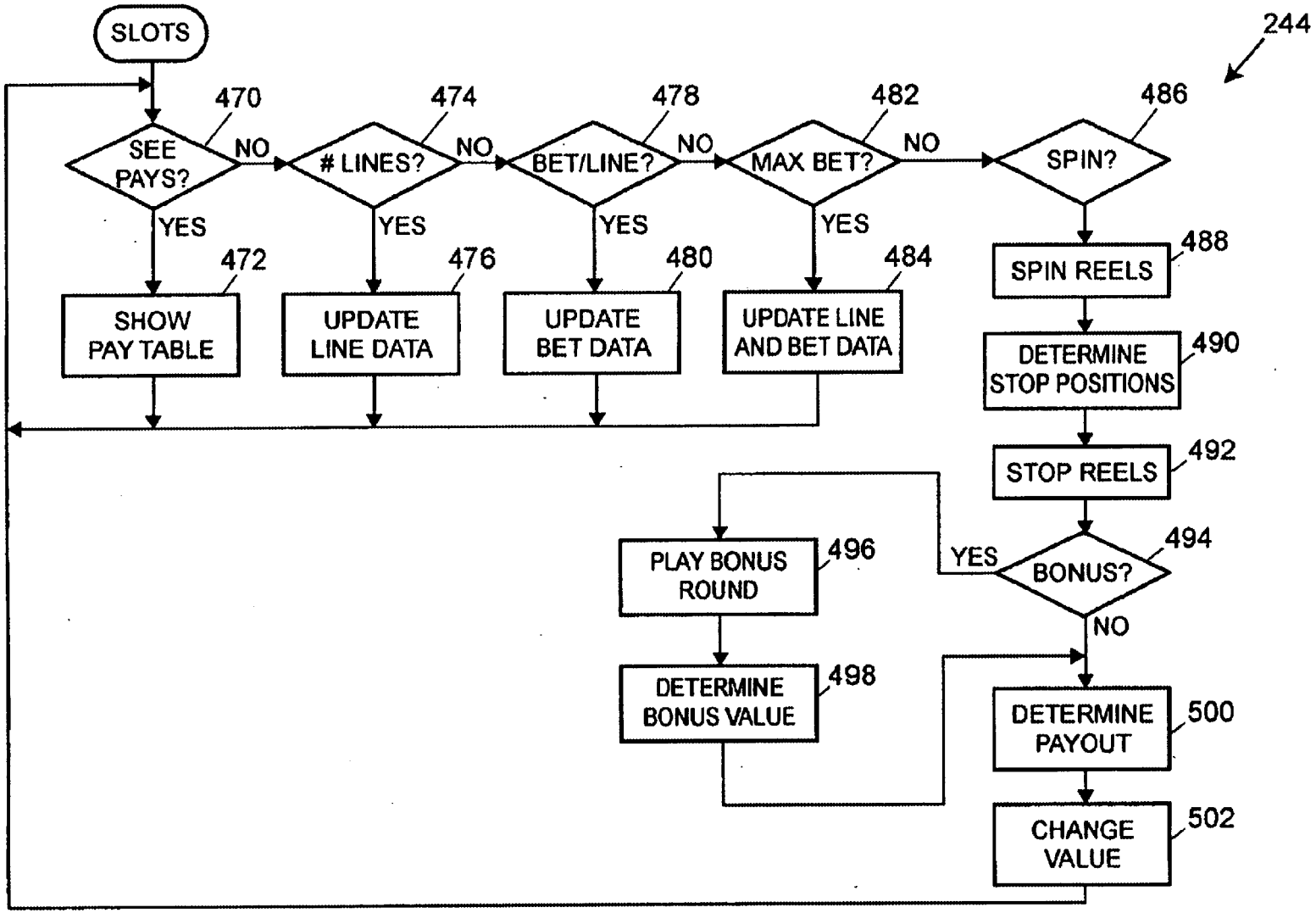
FIG. 15 is a flowchart of an embodiment of a slots routine that may be performed by one or more of the gaming units.

FIG. 15 is a flowchart of the slots routine 244 shown schematically in FIG. 13. Referring to FIG. 15, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spining" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

Figure 14:
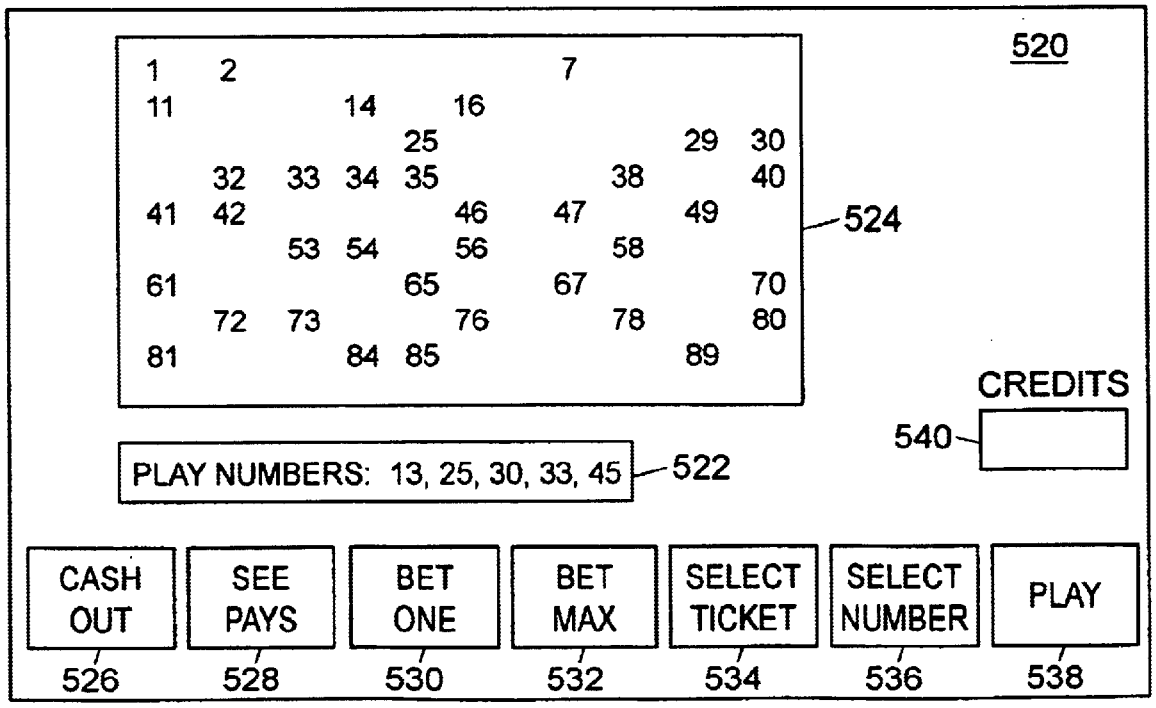
FIG. 14 is an illustration of an embodiment of a visual display that may be displayed during performance of the video keno routine of FIG. 16.

FIG. 14 is an exemplary display 520 that may be shown on the display unit 70 during performance of the video keno routine 246 shown schematically in FIG. 7. Referring to FIG. 14, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 16:
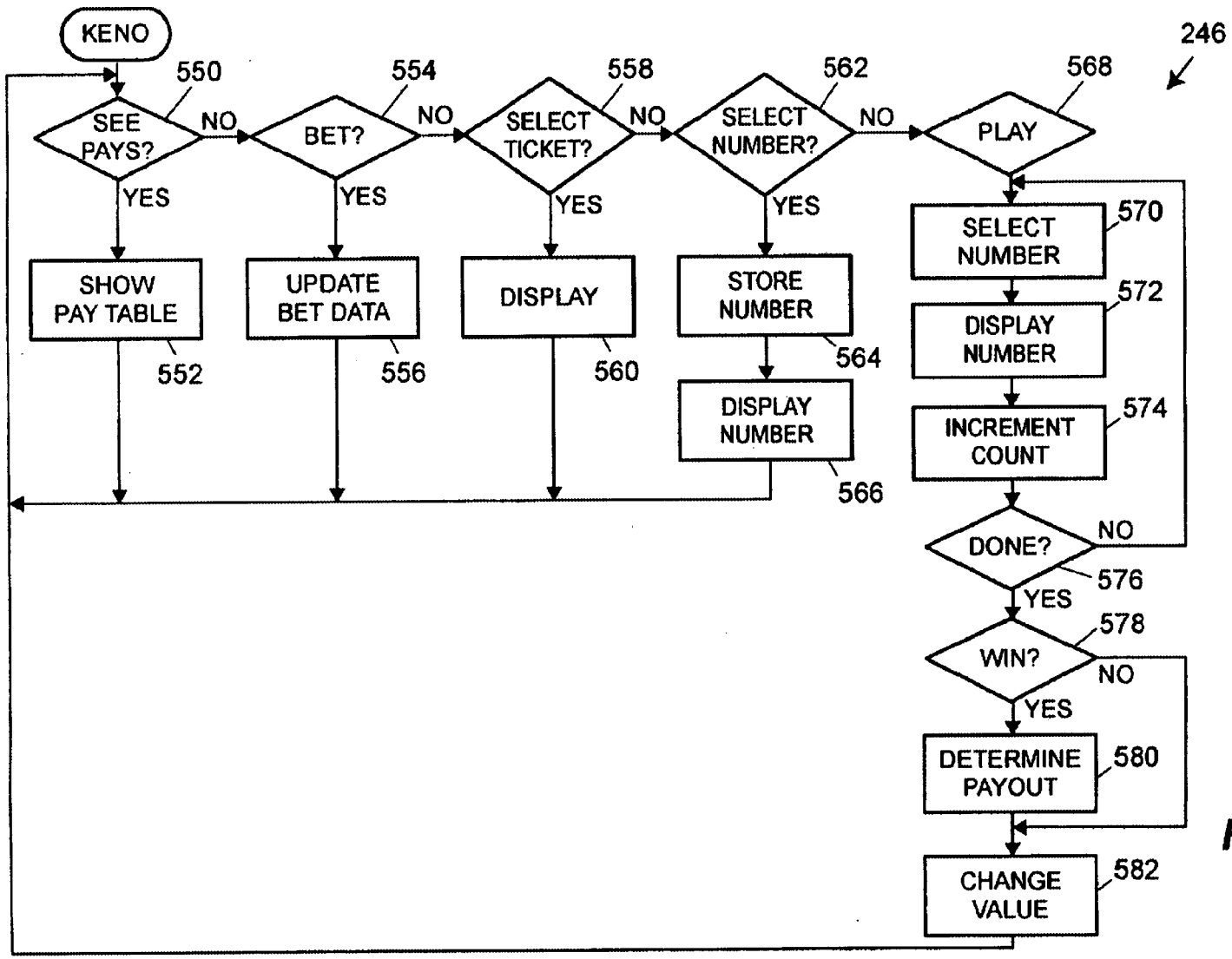
FIG. 16 is a flowchart of an embodiment of a video keno routine that may be performed by one or more of the gaming units.

FIG. 16 is a flowchart of the video keno routine 246 shown schematically in FIG. 7. The keno routine 246 may be utilized in connection with a single gaming unit 20 where a single player is playing a keno game, or the keno routine 340 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 16, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 14).

Video Bingo

Figure 17:
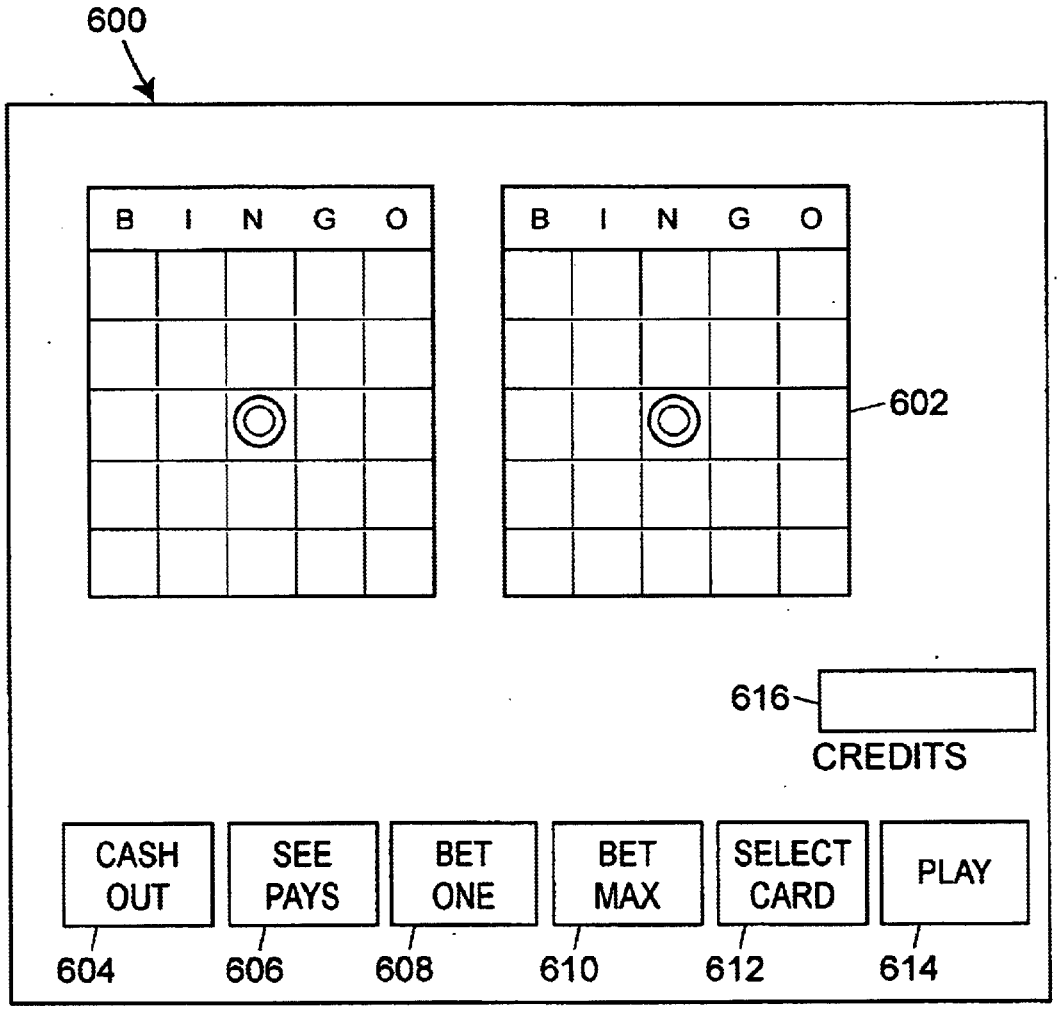
FIG. 17 is an illustration of an embodiment of a visual display that may be displayed during performance of the video bingo routine of FIG. 18.

FIG. 17 is an exemplary display 600 that may be shown on the display unit 70 during performance of the video bingo routine 250 shown schematically in FIG. 7. Referring to FIG. 17, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 18:
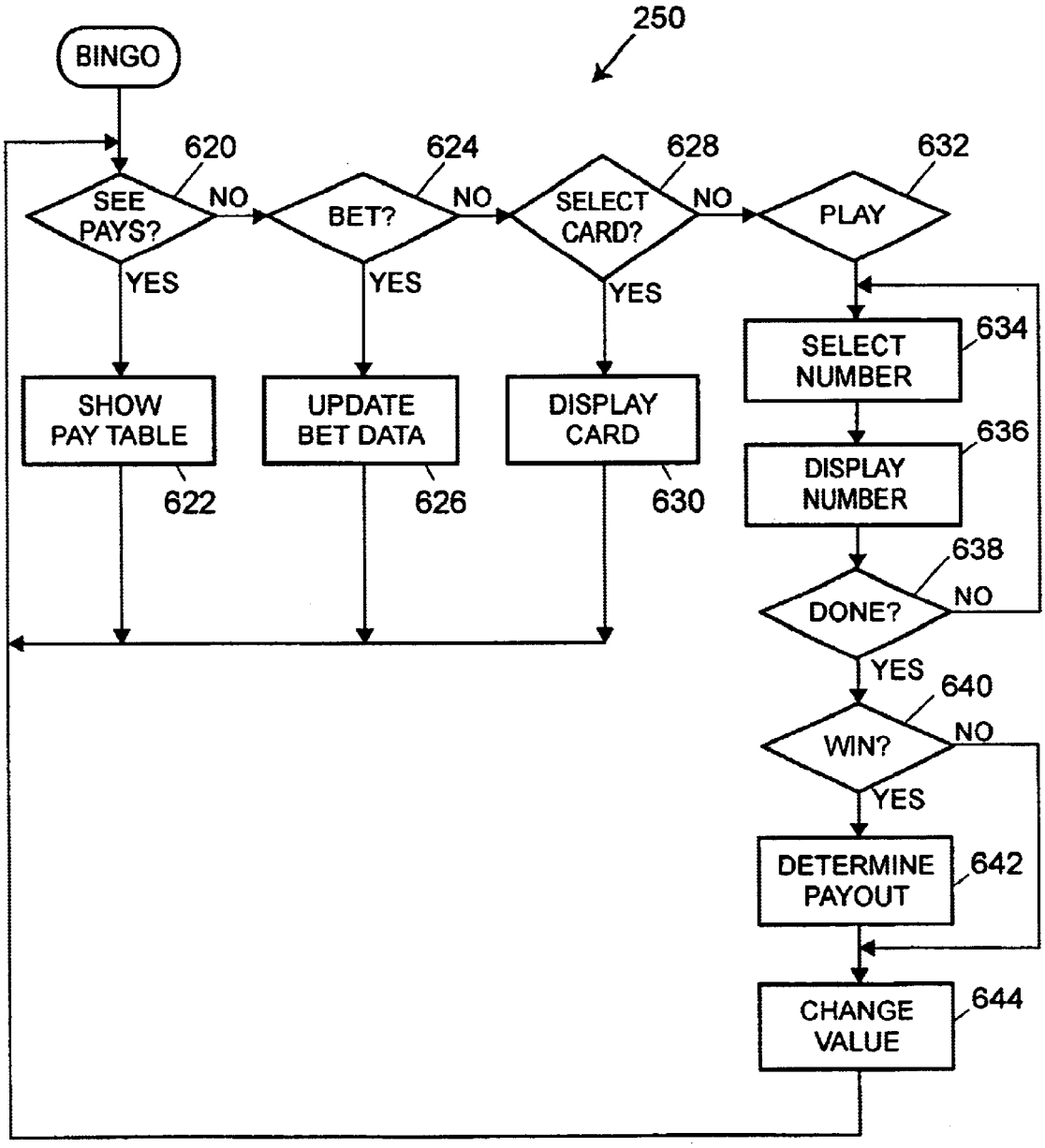
FIG. 18 is a flowchart of an embodiment of a video bingo routine that may be performed by one or more of the gaming units.

FIG. 18 is a flowchart of the video bingo routine 250 shown schematically in FIG. 7. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 18, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 17).

Figure 19:
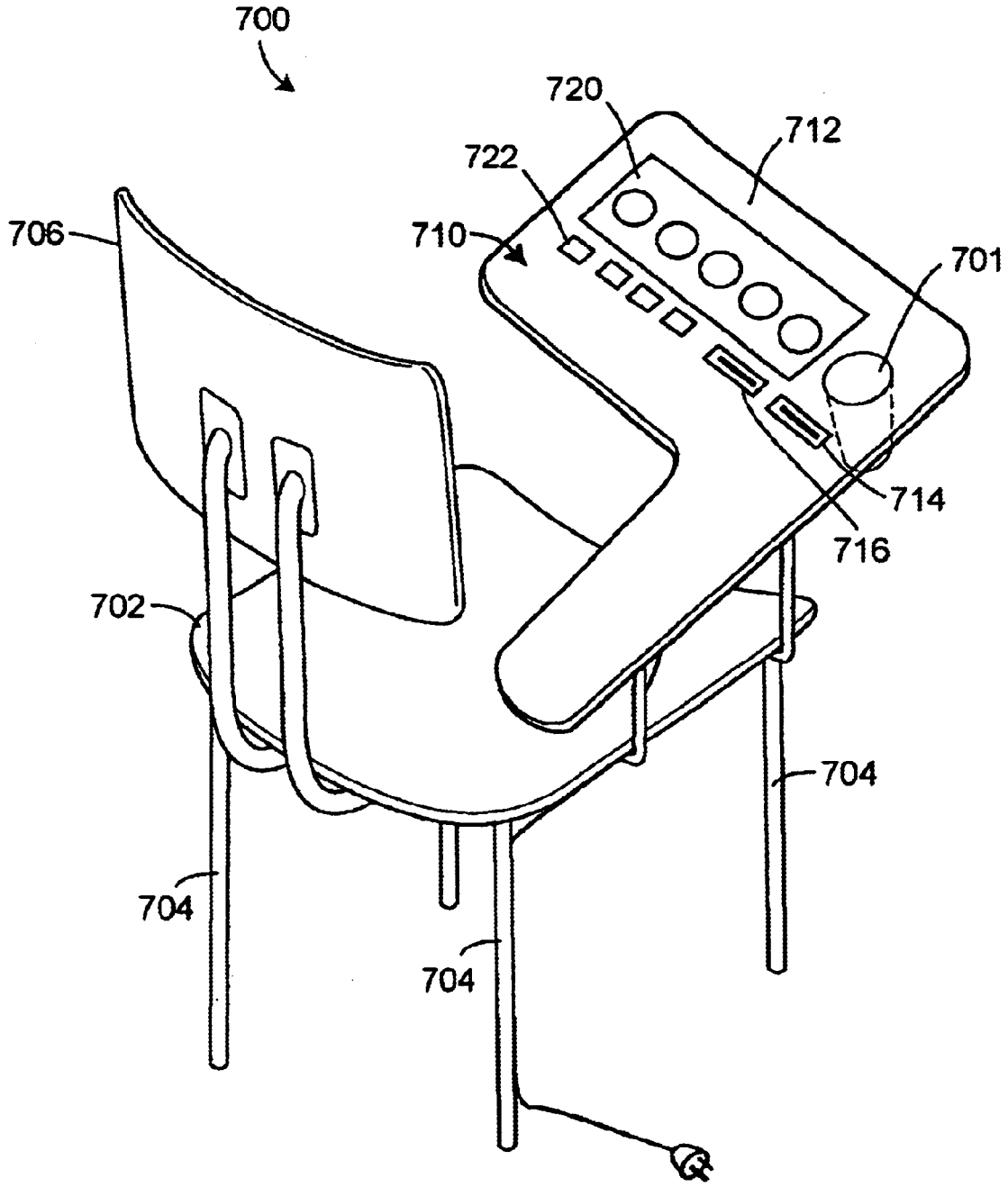
FIG. 19 illustrates an alternative embodiment of a beverage heating and cooling device interconnected to a person seating device.

FIG. 19 illustrates an alternative embodiment of a gaming unit 700 that may include a beverage temperature control system 701 interconnected to a person seating device 702. The person seating device 702 of FIG. 19 is a chair having a plurality of legs 704, a back support 706, and an attached table 710. In this embodiment, the beverage support structure is mounted under the table 710 so that the top of the beverage support structure is in substantially the same plane as a top surface 712 of the table 710. The table 710 also includes a first input/output device 714 and a second input/output device 716. In this embodiment, a display panel 720 and a control panel 722 are also located on the table 710.

As described with reference to FIG. 1, the gaming unit 700 of FIG. 19 may be connected to a larger gaming system. The description of the gaming system 10 of FIG. 1 is hereby incorporated in conjunction with the gaming unit 700 of FIG. 19. Additionally, the gaming unit 700 may also include the components and functions described above in reference to FIGS. 2–3. The description of those components is hereby incorporated in conjunction with the gaming unit 700. Also, the beverage temperature control system 701 may include the components illustrated and described with reference to the embodiment shown in FIGS. 4 and 5. These components are also incorporated in conjunction with the beverage temperature control system 701. The illustrations and descriptions of the operations of the gaming unit 10 from FIGS. 6–18 are also incorporated in conjunction with the gaming unit 700 from FIG. 19.

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A gaming apparatus, comprising:

a housing;

a display unit associated with said housing and capable of generating video images;

a value input device;

a beverage support structure coupled to said housing, said beverage support structure comprising a beverage present detector, a beverage temperature monitor, and a beverage temperature altering mechanism, said temperature altering mechanism comprising a thermoelectric device having a first semiconductor material and a second semiconductor material connected electrically in series and thermally in parallel;

a controller operatively coupled to said display unit, said value input device, said beverage present detector, said beverage temperature monitor, and said beverage temperature altering mechanism, said controller comprising a processor and a memory operatively coupled to said processor, said controller being programmed to allow a person to make a wager, said controller being programmed to cause a video image to be generated on said display unit, said video image representing a game selected from the group of games consisting of video poker, video blackjack, video slots, video keno and video bingo, said video image comprising an image of at least five playing cards if said game comprises video poker, said video image comprising an image of a plurality of simulated slot machine reels if said game comprises video slots, said video image comprising an image of a plurality of playing cards if said game comprises video blackjack, said video image comprising an image of a plurality of keno numbers if said game comprises video keno, said video image comprising an image of a bingo grid if said game comprises video bingo, said controller being programmed to determine a value payout associated with an outcome of said game;

said controller being programmed to detect presence of a beverage having a temperature in said beverage support structure via said beverage present detector, said controller being programmed to monitor said temperature of said beverage in said beverage support structure via said beverage temperature monitor, and said controller being programmed to alter said temperature of said beverage in said beverage support structure via said temperature altering mechanism.

2. A gaming apparatus as defined in claim 1, further comprising a timer operatively coupled to said beverage present detector and said beverage temperature altering mechanism.

3. A gaming apparatus as defined in claim 2, wherein said timer is configured to allow said beverage temperature altering mechanism to remain energized for a predetermined time after said beverage present detector detects the removal of a beverage from said beverage support structure.

4. A gaming apparatus as defined in claim 1, further comprising a power source operatively coupled to said controller, said beverage present detector, said beverage temperature monitor, and said beverage temperature altering mechanism.

5. A gaming apparatus as defined in claim 1, wherein said beverage presence detector generates an output when said beverage is placed on said beverage support structure and said controller is configured to receive said output.

6. A gaming system, comprising:

a plurality of gaming apparatuses, said apparatuses comprising:

a housing;

a display unit associated with said housing and capable of generating video images;

a value input device;

a beverage support structure coupled to said housing, said beverage support structure comprising a beverage present detector and a beverage temperature monitor;

a beverage temperature altering mechanism operatively coupled to said beverage support structure, said temperature altering mechanism comprising a thermoelectric device having a first semiconductor material and a second semiconductor material connected electrically in series and thermally in parallel;

a controller operatively coupled to said display unit, said value input device, said beverage present detector, and said beverage temperature monitor, said controller comprising a processor and a memory operatively coupled to said processor, said controller being programmed to allow a person to make a wager, said controller being programmed to cause a video image to be generated on said display unit, said video image representing a game selected from the group of games consisting of video poker, video blackjack, video slots, video keno and video bingo, said video image comprising an image of at least five playing cards if said game comprises video poker, said video image comprising an image of a plurality of simulated slot machine reels if said game comprises video slots, said video image comprising an image of a plurality of playing cards if said game comprises video blackjack, said video image comprising an image of a plurality of keno numbers if said game comprises video keno, said video image comprising an image of a bingo grid if said game comprises video bingo, said controller being programmed to determine a value payout associated with an outcome of said game;

said controller being programmed to detect presence of a beverage having a temperature in said beverage support structure;

said controller being programmed to monitor the temperature of said beverage in said beverage support structure; and said gaming apparatuses being interconnected to form a network of gaming apparatuses.

7. A gaming system as defined in claim 6, wherein said gaming apparatuses are interconnected via the Internet.

* * * * *